US008093973B2

(12) United States Patent
Takaya et al.

(10) Patent No.: US 8,093,973 B2
(45) Date of Patent: Jan. 10, 2012

(54) MOVABLE CONTACT HOLDER OF ELECTRICAL APPARATUS AND ASSEMBLING METHOD OF THE MOVABLE CONTACT HOLDER

(75) Inventors: Kouetsu Takaya, Saitama (JP); Koji Ohkubo, Saitama (JP); Yasuhiro Naka, Saitama (JP); Toshikatsu Ohgami, Saitama (JP); Kenji Suzuki, Kounosu (JP)

(73) Assignee: Fuji Electric Components and Systems Co., Ltd. (JP)

( * ) Notice: Subject to any disclaimer, the term of this patent is extended or adjusted under 35 U.S.C. 154(b) by 219 days.

(21) Appl. No.: 12/409,658

(22) Filed: Mar. 24, 2009

(65) Prior Publication Data

US 2009/0243769 A1 Oct. 1, 2009

(30) Foreign Application Priority Data

Mar. 24, 2008 (JP) ..... 2008-075282

(51) Int. Cl.
*H01H 63/02* (2006.01)

(52) U.S. Cl. ..... 335/133; 335/132; 335/202

(58) Field of Classification Search ..... 335/127, 335/133–135, 132, 202
See application file for complete search history.

(56) References Cited

U.S. PATENT DOCUMENTS

| | | | | | |
|---|---|---|---|---|---|
| 3,942,144 | A * | 3/1976 | Contal | 335/132 |
| 4,982,060 | A * | 1/1991 | Streich et al. | 200/243 |
| 5,347,250 | A * | 9/1994 | Muske | 335/132 |
| 5,717,370 | A * | 2/1998 | Haas | 335/132 |
| 6,483,049 | B1 * | 11/2002 | Mohtasham | 200/5 R |

FOREIGN PATENT DOCUMENTS

| | | | |
|---|---|---|---|
| JP | 10-223431 | A | 8/1998 |
| JP | 2879783 | B2 | 1/1999 |

* cited by examiner

*Primary Examiner* — Bernard Rojas
(74) *Attorney, Agent, or Firm* — Rossi, Kimms & McDowell LLP

(57) ABSTRACT

A movable contact holder includes a movable contact holder base and a movable contact holder cover. One side of the movable contact holder base is opened to have a plurality of recesses each being formed for holding a contact pair, each contact pair include a bridge contact assembly and a contact spring inserted therein while being isolated from the other pairs. The other side of the movable contact holder base is formed as a bottom wall, and preferably includes openings through which an assembly jig can be inserted from outside the moveable contact holder. Alternatively, jig openings can be formed in lateral side walls of the recesses to allow the assembly jig to be inserted. The movable contact holder cover covers the movable contact holder base and is coupled thereto.

9 Claims, 14 Drawing Sheets

Fig. 12A
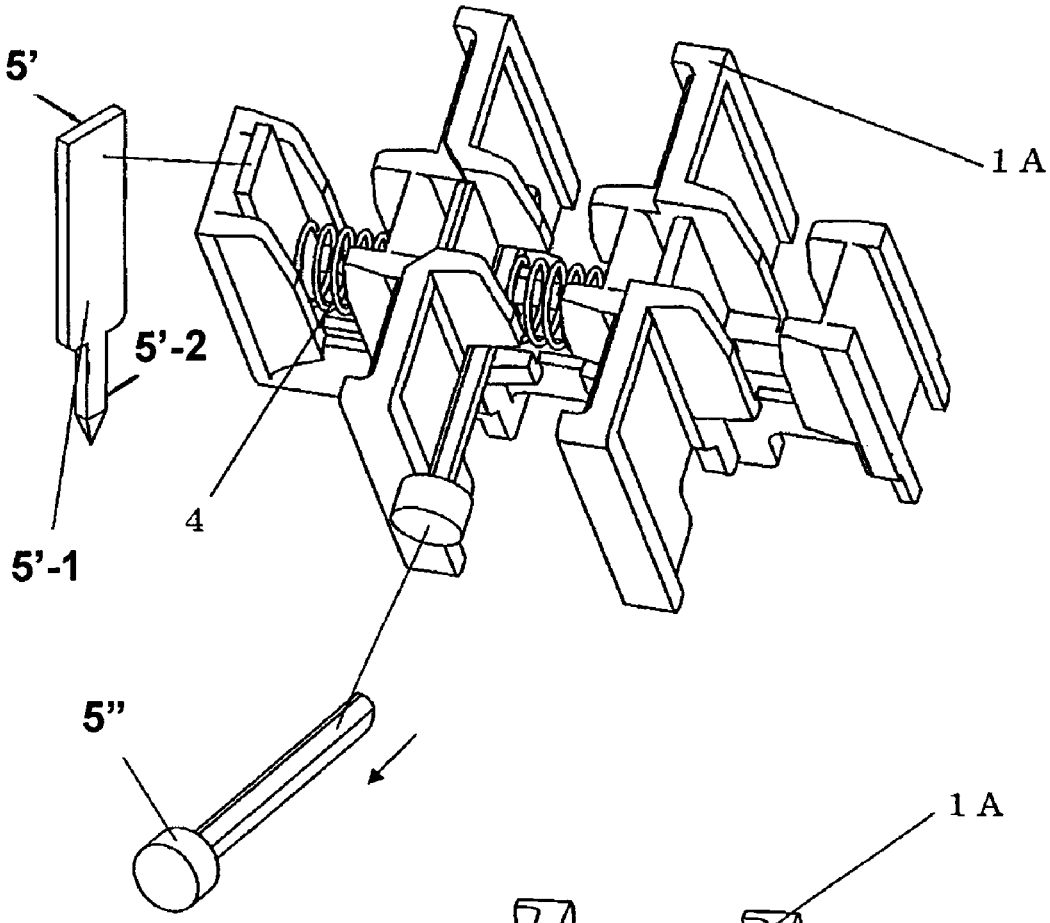
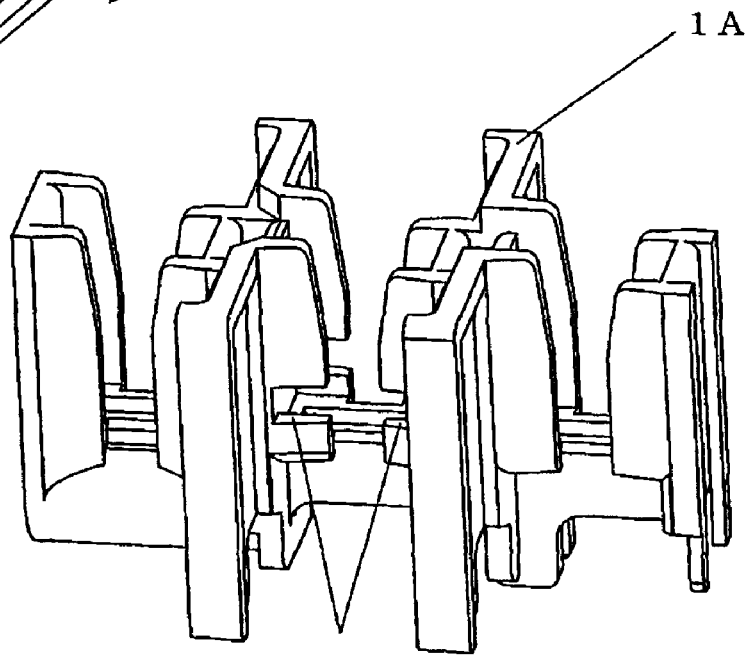
Fig. 12B
1A-6

MOVABLE CONTACT HOLDER OF ELECTRICAL APPARATUS AND ASSEMBLING METHOD OF THE MOVABLE CONTACT HOLDER

BACKGROUND

The present invention relates to a movable contact holder mounted on electrical apparatus, for example, an electromagnetic contactor and an assembling method thereof.

As is well known, an electromagnetic contactor is provided with a movable contact holder having bridge contact assemblies, each being made opposite to a stationary contact assembly of a contact mechanism connected to a main circuit, mounted on a movable contact holder base of insulator material (molded resin) to be held therein while each being made combined with a contact spring (a compressed coil spring pressing the bridge contact assembly against the stationary contact assembly to apply a contact pressure to the contact faces of both of the bridge contact and the stationary contact with both of the contacts being made closed). The movable contact holder is coupled to a movable core of an operation electromagnet to be driven to either one of ON and OFF positions for closing and opening, respectively, the contacts by controlling an electric current flowing in the coil of the electromagnet.

The driving systems of the movable contact holder may be classified into vertical slide systems and horizontal slide systems. A vertical slide system is one in which the movable contact holder is operated to slide up and down to open and close the contacts. A horizontal slide system is one in which the movable contact holder is operated to slide side to side to open and close the contacts. For the latter horizontal slide system, the system of the electromagnetic contactor disclosed in FIG. 1 in JP-A-10-223431, for example, is publicly known. In the electromagnetic contactor disclosed in FIG. 1 in JP-A-10-223431, an electromagnet is of a support type, in which a movable contact holder is to be operated so as to slide side to side with the top end of a lever of a movable core, moveably coupled to a fixed core by a hinge, coupled to the movable contact holder. Moreover, an arrangement is also known in which, instead of the support type electromagnet, an ordinary leg type or plunger type electromagnet is horizontally laid under a movable contact holder to connect the movable core and the plunger of the electromagnet to the movable contact holder by an operation lever of a separated component so as to operate the movable contact holder to slide side to side.

Next to this, about the electromagnetic contactor disclosed in FIG. 1 in JP-A-10-223431, the structure of a movable contact holder mounted thereon will be explained with reference to FIG. 10. Moreover, an assembling method of the movable contact holder, by which method bridge contact assemblies and contact springs are attached to a movable contact holder base, will be explained with reference to FIGS. 11A to 11E.

First, in FIG. 10, a movable contact holder 1' has a movable contact holder base 1" of a molded product of resin, bridge contact assemblies 2 each corresponding to a main circuit contact assembly, bridge contact assemblies 3 each corresponding to an auxiliary contact assembly, bridge contacts 2*a* each provided at each end of the bridge contact assembly 2, bridge contacts 3*a* each provided at each end of the bridge contact assembly 3 and contact springs (compressed coil springs) 4. The movable contact holder base 1" has a plurality of square openings 1*a* opened in a line in the lateral direction in a laterally long block. In each of the square openings 1*a*, the bridge contact assembly 2 or 3 is inserted to be held transversely to the lateral direction while being paired with the contact spring 4 as illustrated. Reference numeral 1*b* denotes a protrusion that indicates an operating state of the electromagnetic contactor, namely, whether the electromagnetic contactor is turned-ON or turned-OFF. Reference numeral 1*c* denotes a channel into which a top end of an operation lever is fitted which is coupled to a movable core of an electromagnet (not shown).

While, in the process of assembling the movable contact holder 1', the bridge contact assemblies 2 and 3 and the contact springs 4 are to be attached to the movable contact holder base 1" by the working steps as shown in FIGS. 11A to 11E. Namely, in the initial assembling processes, the bridge contact assembly 2 is inserted into the square opening 1*a* from the side of the movable contact holder base 1" with the surface of the bridge contact assembly 2 being made a little inclined from the vertical direction (see FIGS. 11A and 11B). Subsequent to this, the state of the bridge contact assembly 2 inserted into the square opening 1*a* is returned to its original state so that the face of the bridge contact 2*a* of the bridge contact assembly 2 becomes vertical before the bridge contact assembly 2 is brought to the one end side of the square opening 1*a* (see FIG. 11C). Then, as shown in FIG. 11D, the contact spring (compressed coil spring) 4 in a free length is compressed and then, with the compressed state being kept as it is, pressed or inserted sideways into a space between the side wall surface inside the square opening 1*a* and the bridge contact assembly 2 to be made fitted to the space. The state in which the bridge contact assembly 2 and the contact spring 4 are attached to the movable contact holder base 1" is shown in FIG. 11E. Further, with the same procedure as the foregoing, the remaining pairs, each with the bridge contact assembly 2 or 3 and the contact spring 4, are inserted into the square openings 1*a* of the bridge contact assembly base 1" one by one in succession, by which the movable contact holder 1' is completed. In the present status, the assembling work of the movable contact holder 1' is entirely carried out manually.

Recently, in order to increase productivity and reduce manufacturing expenses, automation of parts assembly is expanding by introducing assembly robot systems into manufacturing lines of electric apparatus. In the movable contact holder 1' with the related structure shown in FIG. 10, when the bridge contact assemblies 2 and 3 and the contact springs 4 are attached to the movable contact holder base 1", as was explained about the assembling method shown in FIGS. 11A to 11E, there are required the steps of inserting the bridge contact assemblies 2 and 3 and the contact springs 4 sideways into the small square openings 1*a* opened in the movable contact holder base 1". However, for carrying out the insertion steps with an automated machine, there is a limitation due to handling of the components with minute external shapes. Namely, it is considerably difficult for an automated machine to pick up and attach the contact spring 4 as a minute component to the movable contact holder base 1" by pressing or inserting the spring 4 sideways into the narrow space while the spring 4 is compressed. This problem has been preventing the automatization of such assembling from being brought into realization.

In view of the above, it would be desirable to provide a movable contact holder with an improved structure that would enable automatic assembly of even minute components.

SUMMARY OF THE INVENTION

The invention provides a movable contact holder of an electrical apparatus in which the related structure is improved so as to enable automatic assembly, and an assembling method of attaching components such as the bridge contact assemblies and the contact springs to the movable contact holder.

According to a preferred embodiment of the invention, in a movable contact holder of an electrical apparatus mounted with a plurality of pairs each with a bridge contact assembly and a contact spring, the movable contact holder being coupled to a movable core of an electromagnet that is driven to shift the bridge contact assembly between an opening position and a closing position, the movable contact holder is made to have a structure including a movable contact holder base and a movable contact holder cover. One side of the movable contact holder base is opened to have a plurality of recesses each being formed for holding each pair of the bridge contact assembly and the contact spring that are inserted therein while being isolated from the other pairs. The other side opposite to the opened side is formed as a bottom wall of each of the recesses, the bottom wall having an opening opened in the direction of compressing the contact spring for inserting an assembling jig from the outside. Alternatively, a lateral side wall of the recesses is provided with an opening for inserting an assembly jig from the outside. The movable contact holder covers the movable contact holder base and is coupled thereto.

In addition, a method of assembling when attaching the bridge contact assemblies and the contact springs to the movable contact holder with the above structure is to be carried out through the following steps. Namely, the movable contact holder is assembled through the steps including: a first step of inserting an assembling jig into each of the recesses from one side of the movable contact holder base through the opening opened in the bottom wall of the recess or an opening in the lateral side wall of the recesses and bringing the inserted assembling jig to one end side of the opening to be on standby with the movable contact holder cover being removed; a second step of inserting a contact spring into a space in each of the recesses from one side of the movable contact holder base to be attached thereto while being kept in a free length state, the space being between the assembling jig and a wall surface on the other end side of the opening inside the recess; a third step of shifting the assembling jig in each of the recesses along the opening to compress the contact spring from the free length state and bringing the contact spring to a wall surface on the other end side of the opening in the recess; a fourth step of inserting a bridge contact assembly into a space in each of the recesses from one side of the movable contact holder base to attach the bridge contact assembly to the movable contact holder base with the contact spring being compressed and brought to the wall surface on the other end side of the opening in the recess, the space being between a wall surface on the one end side of the opening and the assembling jig compressing the contact spring of the recess; and a fifth step of drawing out the assembling jig from each of the recesses in the movable contact holder base after the bridge contact assembly is attached and laying a movable contact holder cover on the one side of the movable contact holder base to be made combined with the movable contact holder base.

In the assembling method according to the invention as described in the foregoing, the steps of inserting, drawing out and shifting the assembling jig into, from and in the movable contact holder base, and the steps of attaching the bridge contact assembly and the contact spring to the movable contact holder base for being attached thereto are carried out by operating an automatic assembling system.

By employing the movable contact holder with the above described structure and attaching the bridge contact assemblies and the contact springs to the movable contact holder base by the above described assembling method, the following advantages can be achieved in an aspect of assembling workability. Namely, in the step of attaching the bridge contact assemblies and the contact springs to the movable contact holder base, in step with the shifting operation of an assembling jig, a contact spring in a free length and a bridge contact assembly paired with the contact spring are inserted in the order into each of the recesses formed in the movable contact holder base directly from above to be mounted in place, by which a plurality of pairs of the components can be attached at their respective specified positions together. Thus, unlike the assembling method of the related movable contact holder, there are required no complex procedures such that the bridge contact assembly to be inserted into the square openings in the movable contact holder base is inclined and that the contact springs in a free length is compressed to be pressed sideways into the square openings in the movable contact holder base. This enables automated assembly of the movable contact holder to be efficiently carried out in which the bridge contact assemblies and the contact springs are attached to the movable contact holder base by operating a simple automated machine instead of related assembly work carried out manually.

BRIEF DESCRIPTION OF THE DRAWINGS

The invention will be described with reference to certain preferred embodiments thereof along with the accompanying drawings, wherein:

FIGS. 12A and 12B are perspective views showing a further embodiments of the invention.

DESCRIPTION OF THE PREFERRED EMBODIMENTS OF THE INVENTION

Figure 1:
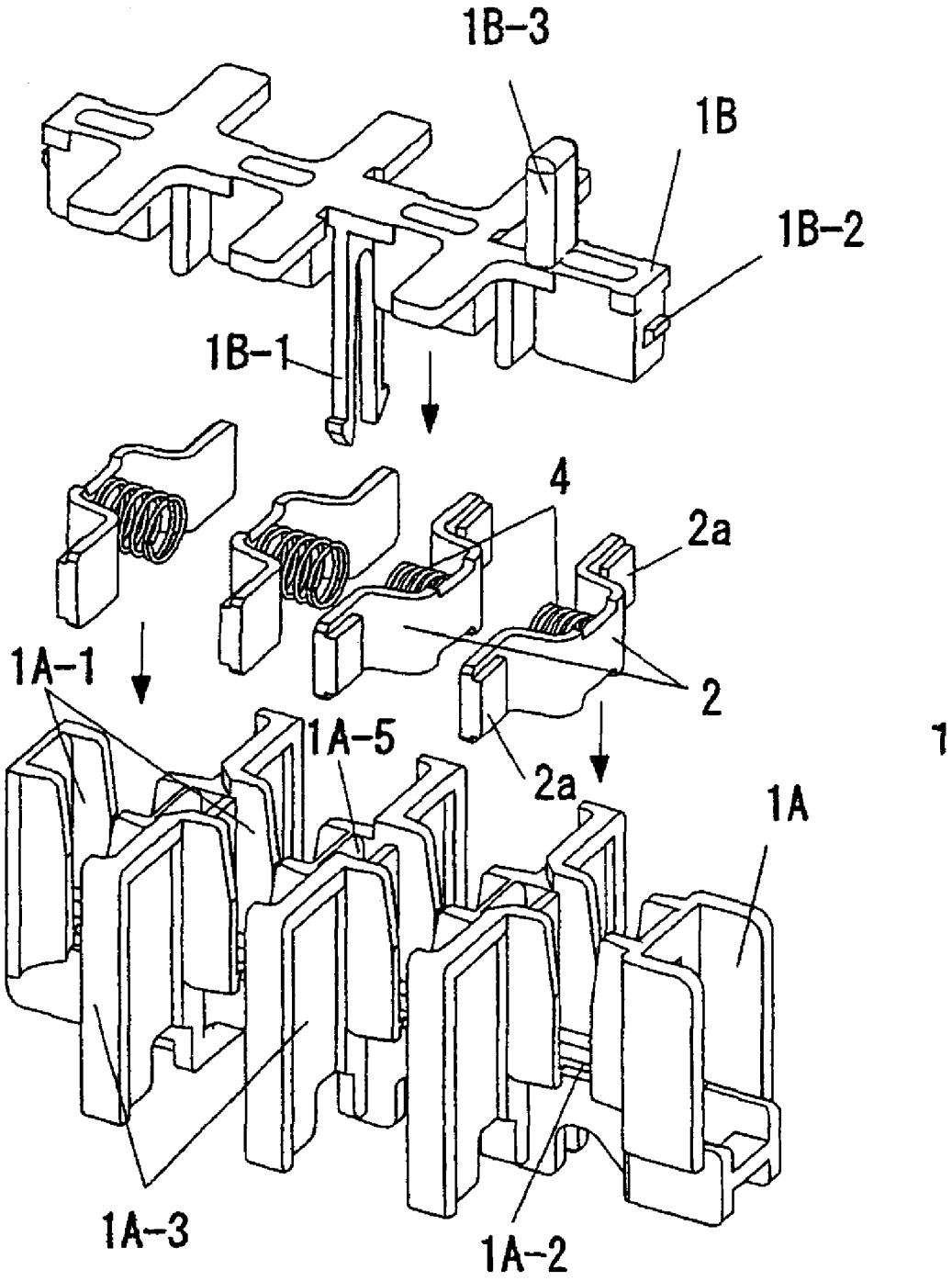
FIG. 1 is an exploded perspective view showing a movable contact holder according to an embodiment of the invention together with bridge contact assemblies and contact springs.
Figure 2:
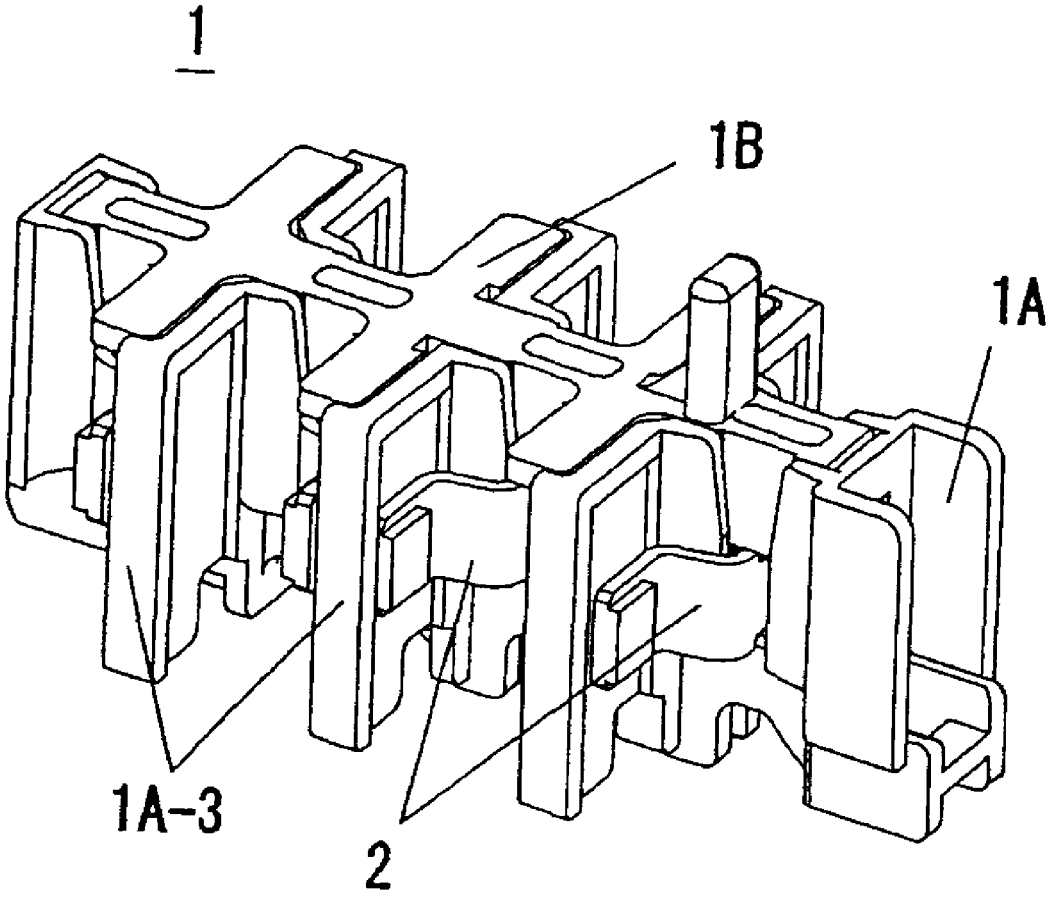
FIG. 2 is a perspective view showing the movable contact holder shown in FIG. 1 in an assembled state.
Figure 3A:
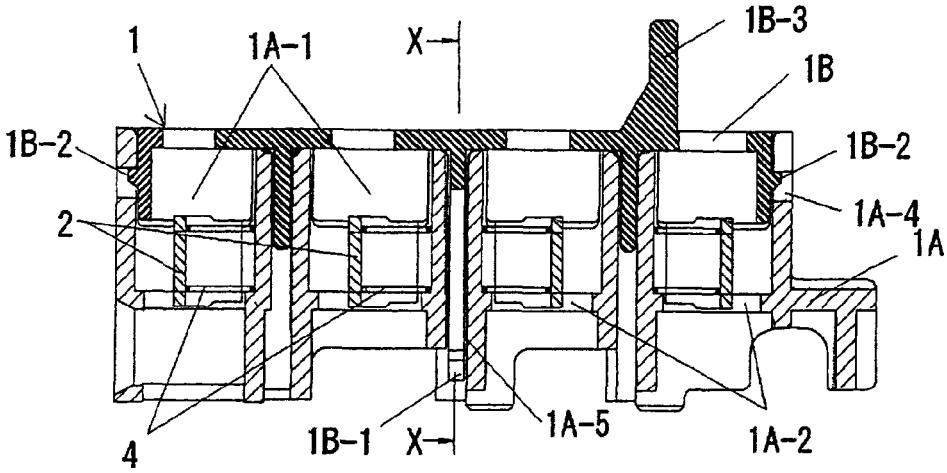
FIG. 3A is an elevational view in section showing a detailed structure of the movable contact holder shown in FIG. 2.
Figure 3B:
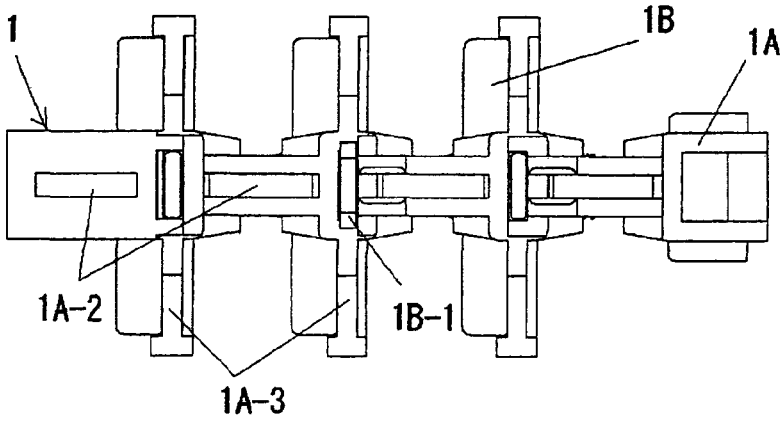
FIG. 3B is a bottom view showing a detailed structure of the movable contact holder shown in FIG. 2.
Figure 3C:
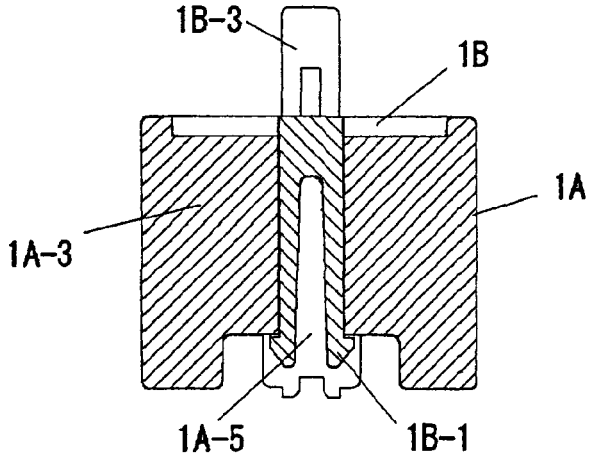
FIG. 3C is a cross sectional view taken along line X-X of FIG. 3A.
Figure 7:
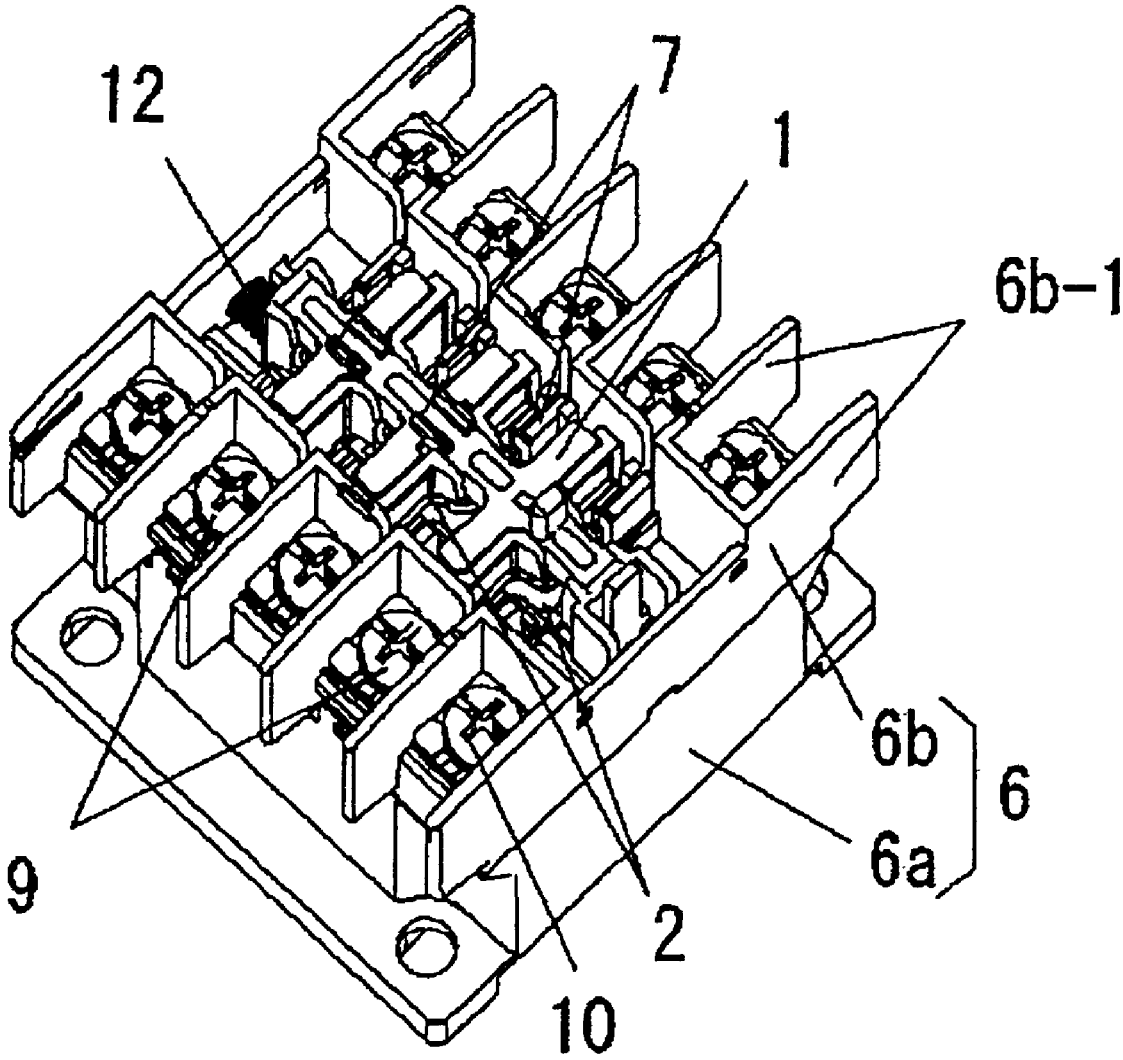
FIG. 7 is a perspective view showing the whole structure of an electromagnetic contactor mounting the movable contact holder according to the embodiment shown in FIG. 2.
Figure 8:
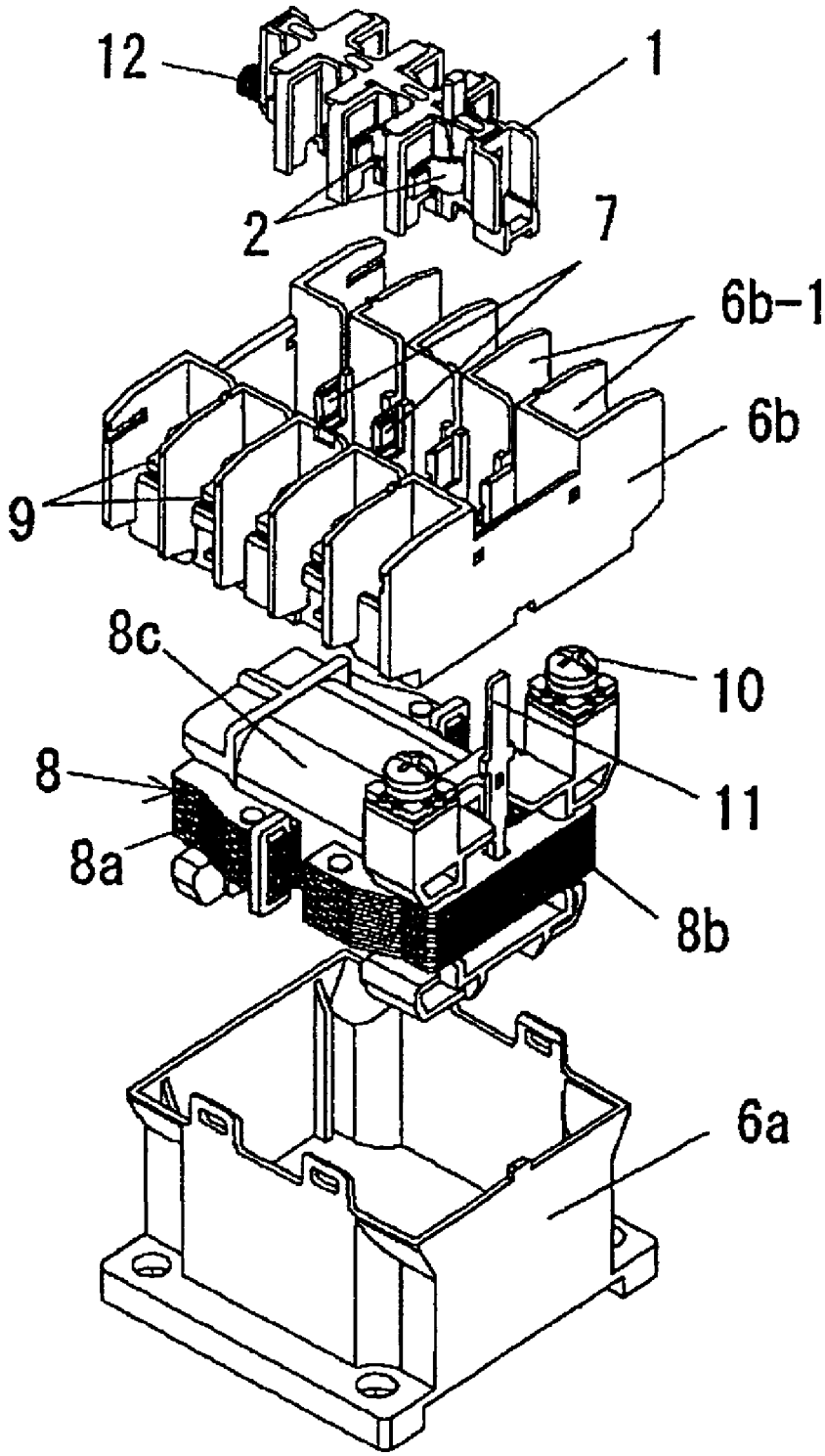
FIG. 8 is an exploded perspective view showing the electromagnetic contactor shown in FIG. 7.
Figure 9A:
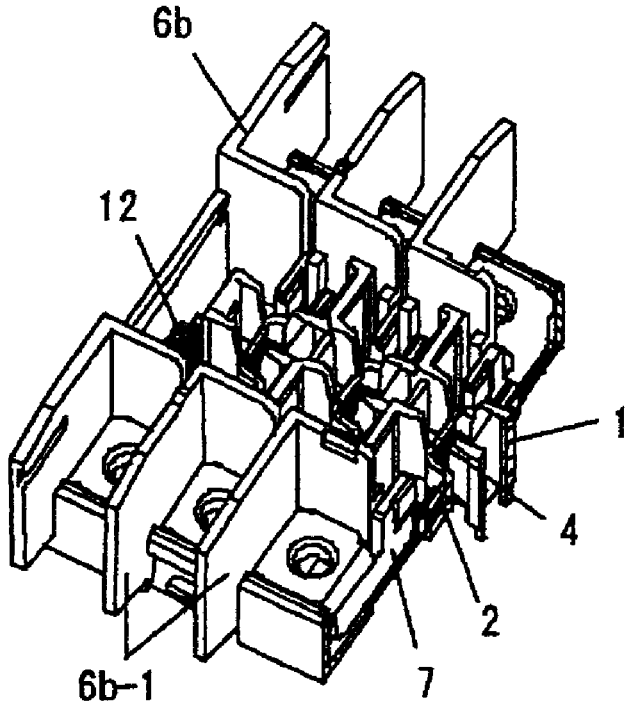
FIG. 9A is an enlarged perspective view showing the assembled structure around the movable contact holder with bridge contact assemblies corresponding to a-contacts in the electromagnetic contactor shown in FIG. 7.
Figure 9B:
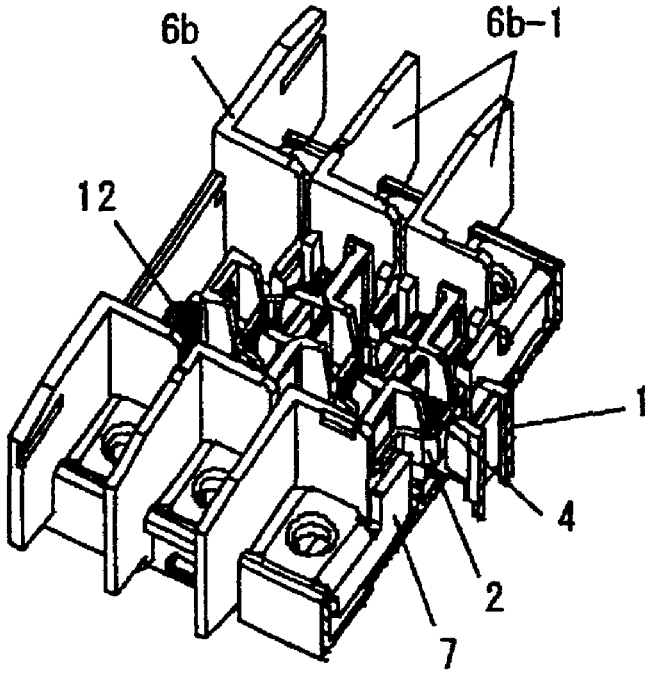
FIG. 9B is an enlarged perspective view showing the assembled structure around the movable contact holder with bridge contact assemblies corresponding to b-contacts in the electromagnetic contactor shown in FIG. 7.
Figure 10:
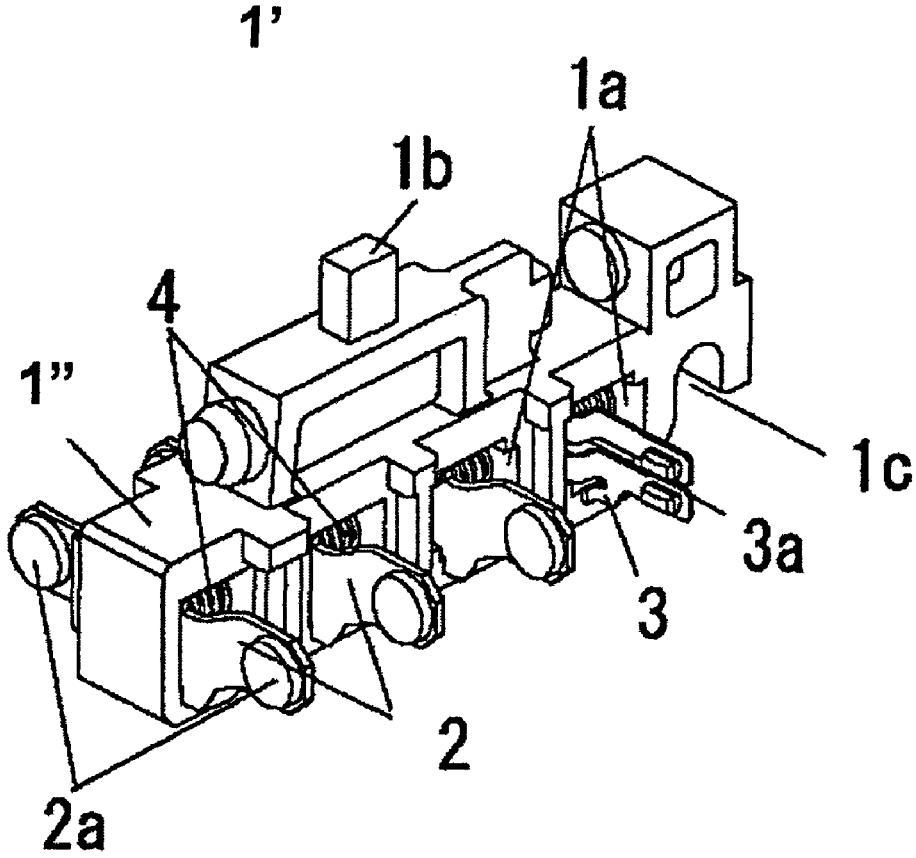
Fig. 10 (Prior Art)
FIG. 10 is a perspective view showing a related lateral sliding movable contact holder mounted on a related electromagnetic contactor in an assembled state with a plurality of pairs of bridge contact assemblies and contact springs attached thereto.
Figure 11A:
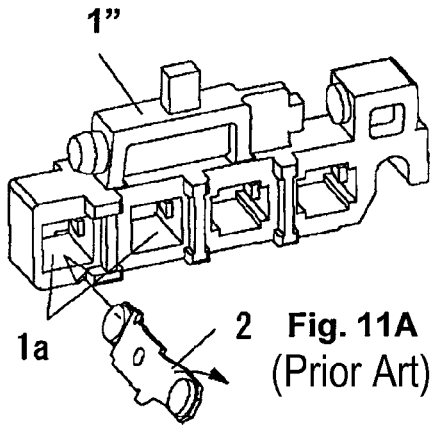
Fig. 11A (Prior Art)
FIGS. 11A to 11E are perspective views showing the steps of attaching bridge contact assemblies and contact springs to the movable contact holder base shown in FIG. 10 in the order in a related assembling method of a movable contact holder.
Figure 11D:
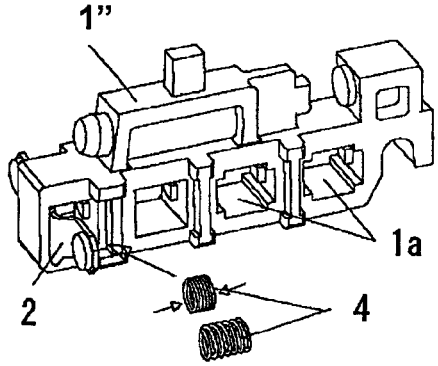
Fig. 11D (Prior Art)
Figure 11B:
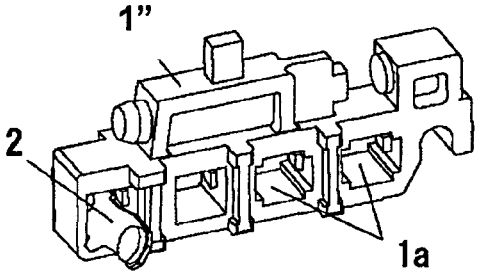
Fig. 11B (Prior Art)
Figure 11E:
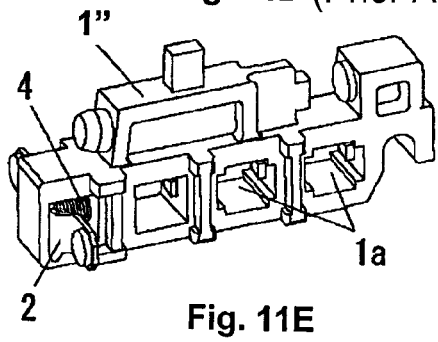
Fig. 11E (Prior Art)
Figure 11C:
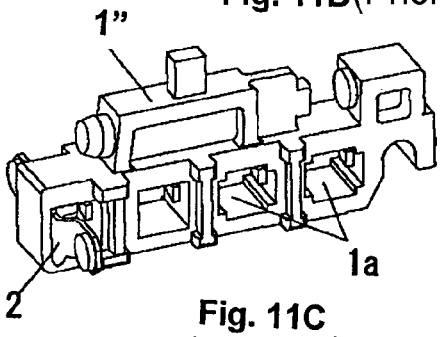
Fig. 11C (Prior Art)

In the following, an embodiment of the invention will be explained on the basis of FIG. 1 to FIG. 9B. FIG. 1 is an exploded perspective view showing a movable contact holder according to the embodiment together with bridge contact assemblies and contact springs. FIG. 2 is a perspective view showing the movable contact holder shown in FIG. 1 in an assembled state. FIGS. 3A, 3B and 3C are an elevational view in section, a bottom view and a cross sectional view taken along line X-X of FIG. 3A, respectively, each showing a detailed structure of the movable contact holder shown in FIG. 2. FIGS. 4A to 4E are cross sectional views showing the assembled states in the order in the steps of assembling the movable contact holder by attaching the bridge contact assemblies and the contact springs to the movable contact holder base shown in FIG. 1 with the use of an assembling jig. FIGS. 5A to 5E are enlarged perspective views showing the assembled states of the principal part of the movable contact holder corresponding to the assembled states shown in FIGS. 4A to 4E, respectively. FIGS. 6A to 6E are enlarged overhead views showing the assembled states of the principal part of the movable contact holder also corresponding to the assembled states shown in FIGS. 4A to 4E, respectively. FIG. 6F is an enlarged overhead view showing the assembled state of the principal part of the movable contact holder with a movable contact holder cover being laid over the upper side of the movable contact holder base in the assembled state in FIG. 6E. FIG. 7 is a perspective view showing the whole structure of an electromagnetic contactor mounting the movable contact holder according to the embodiment shown in FIG. 2. FIG. 8 is an exploded perspective view showing the electromagnetic contactor shown in FIG. 7. FIG. 9A is an enlarged perspective view showing the assembled structure around the movable contact holder with bridge contact assemblies corresponding to a-contacts in the electromagnetic contactor shown in FIG. 7, and FIG. 9B is an enlarged perspective view showing the assembled structure around the movable contact holder with bridge contact assemblies corresponding to b-contacts in the electromagnetic contactor shown in FIG. 7. In the drawings of the embodiment, components corresponding to those in FIG. 10 are denoted by the same reference numerals and signs.

First, in FIG. 1 to FIG. 3C, a movable contact holder 1 (molded product of resin) is divided into two, a movable contact holder base 1A with one side (upper side) thereof opened, and a movable contact holder cover 1B that covers the one side (upper side) of the movable contact holder base 1A when it is coupled thereto. To the movable contact holder 1, a plurality of contact pairs (four pairs in the illustrated embodiment), each including a bridge contact assembly 2 combined with a contact spring 4, are attached while being laterally arranged. In the illustrated embodiment, of the four pairs of the bridge contact assemblies 2 and the contact springs 4, two pairs on the left side form the a-contacts and two pairs on the right side form the b-contacts.

Here, in the movable contact holder base 1A, recesses (four recesses in the illustrated embodiment) 1A-1 are formed while being laterally arranged so that each pair of the bridge contact assembly 2 and the contact spring 4 is mounted therein while being isolated from others. Further, a bottom wall in each of the recesses 1A-1 has an opening 1A-2 opened along the direction of compressing the contact spring 4 for inserting an assembling jig (that will be explained later in greater detail) upward from under the bottom wall. The sidewall of the recess 1A-1 is cut away at the central section with each of the lateral end sections being left as it is, such that a slot if formed in the sidewall that extends downward from the open side. This is for making the bridge contact assembly 2 held in the movable contact holder 1 protrude aside from the movable contact holder base 1A to make a bridge contact 2*a* disposed at each end of the bridge contact assembly 2 opposite to a stationary contact of a stationary contact assembly externally provided on each side of the recess 1A-1. Moreover, between the recesses 1A-1 adjacent to each other, an insulation barrier 1A-3 is formed while being made to protrude aside.

While, the movable contact holder cover 1B of the movable contact holder 1 has a pair of engaging pieces 1B-1 formed in bifurcated-legs-like and engaging protrusions 1B-2 each being formed at each lateral end of the cover 1B. The engaging pieces 1B-1 and the engaging protrusions 1B-2 are provided as snap-fit combining means for making the movable contact holder cover 1B engaged with the movable contact holder base 1A to be combined therewith the movable contact holder cover 1B covering the upper side of the movable contact holder base 1A. A pair of the engaging pieces 1B-1 have engaging claws at their respective tips and are inserted into a through hole 1A-5 provided in the vertical direction in the movable contact holder base 1A to be made engaged with the bottom of the movable contact holder base 1A by the engaging claws at the tips. The engaging protrusion 1B-2 is made engaged with an engaging hole 1A-4 (see FIG. 3A) opened in each lateral end surface of the movable contact holder base 1A. Here, reference numeral 1B-3 denotes a protrusion for indicating the state of operation of the electromagnetic contactor (corresponding to the protrusion 1*b* shown in FIG. 10).

By making the movable contact holder cover 1B cover the movable contact holder base 1A from the upper side thereof and pressing the movable contact holder cover 1B into the movable contact holder base 1A, the engaging pieces 1B-1 of the movable contact holder cover 1B are made to pass through the through hole 1A-5 to engage with the bottom wall of the movable contact holder base 1A by the claws at the tips of the engaging pieces 1B-1 as shown in FIG. 3C. Along with this, the engaging protrusion 1B-2 at each end of the movable contact holder cover 1B is made engaged with an engaging hole 1A-4 opened in each end wall of the movable contact holder base 1A, by which a mechanically firm combination of the movable contact holder base 1A and movable contact holder cover 1B is provided for an integrated movable contact holder 1.

Next, an assembling method of attaching the bridge contact assemblies 2 and contact springs 4 to the movable contact holder 1 with the use of assembling jigs will be explained with reference to FIGS. 4A to 4E, FIGS. 5A to 5E and FIGS. 6A to 6F. Here, the assembled states shown in FIGS. 4A to 4E correspond to the assembled states of the movable contact holder 1 in the following first to fifth steps, respectively. The assembled states shown in FIGS. 5A to 5E correspond to the states shown in FIGS. 4A to 4E, respectively. The assembled states shown in FIGS. 6A to 6D also correspond to the states shown in FIGS. 4A to 4D, respectively, and the assembled states shown in FIGS. 6E and 6F correspond to the state shown in FIG. 4E.

Figure 4A:
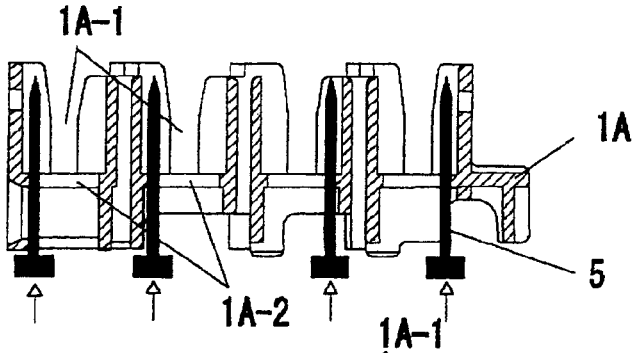
FIGS. 4A to 4E are cross sectional views showing the assembled states in the order in the steps of assembling the movable contact holder by attaching the bridge contact assemblies and the contact springs to the movable contact holder base shown in FIG. 1 with the use of an assembling jig.
Figure 4B:
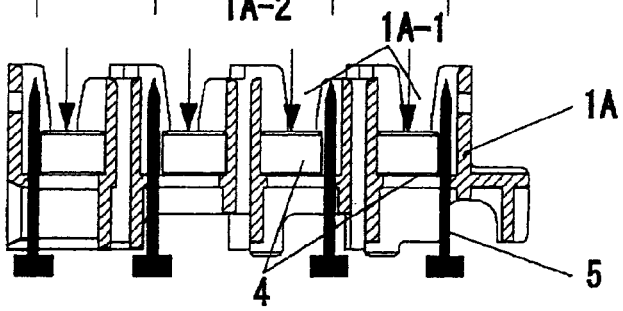
Figure 4C:
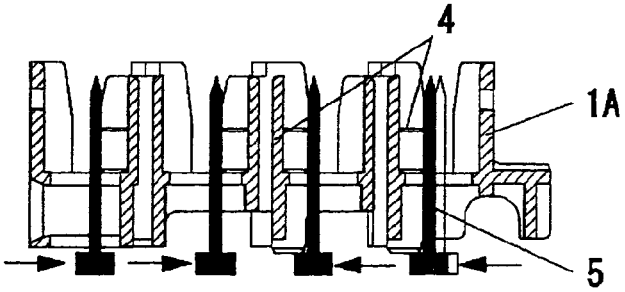
Figure 4D:
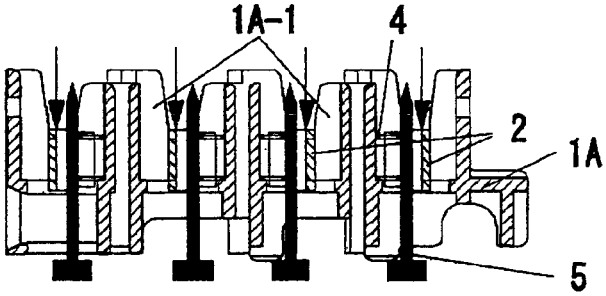
Figure 4E:
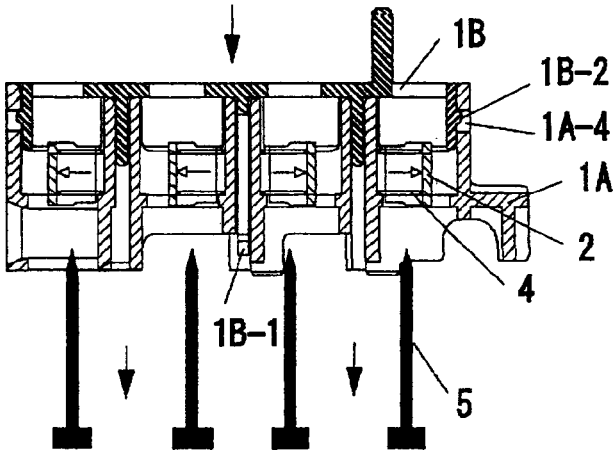
Figure 5A:
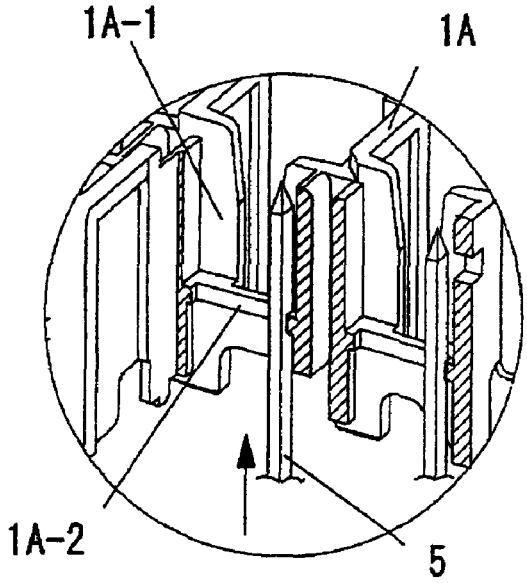
FIGS. 5A to 5E are enlarged perspective views showing the assembled states of the principal part of the movable contact holder corresponding to the assembled states shown in FIGS. 4A to 4E, respectively.
Figure 5B:
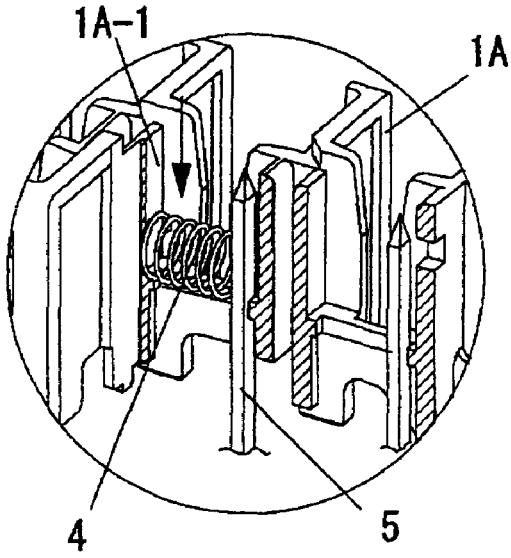
Figure 5C:
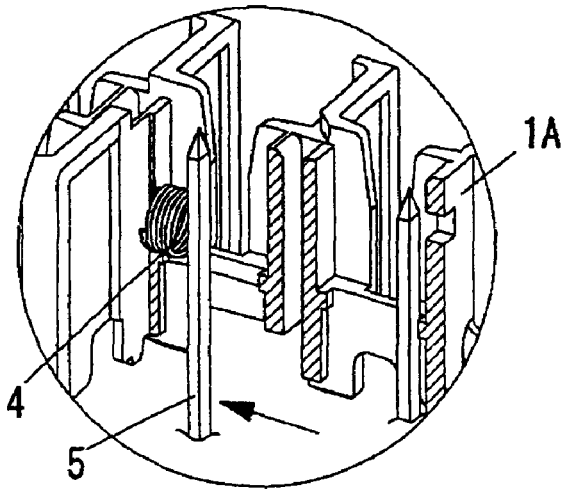
Figure 5D:
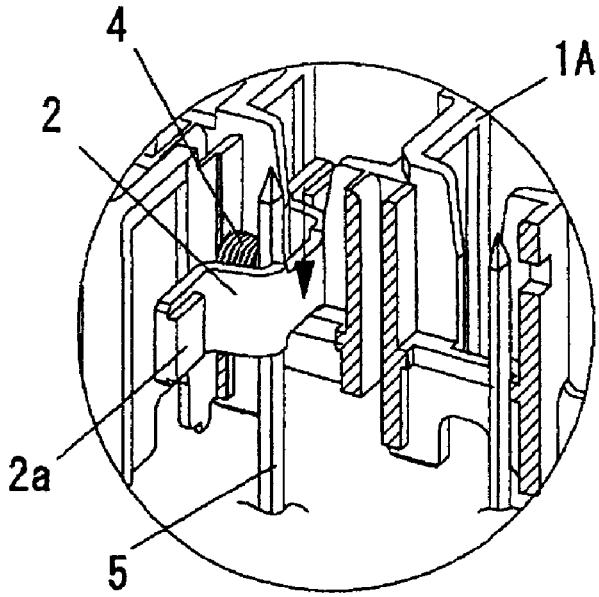
Figure 5E:
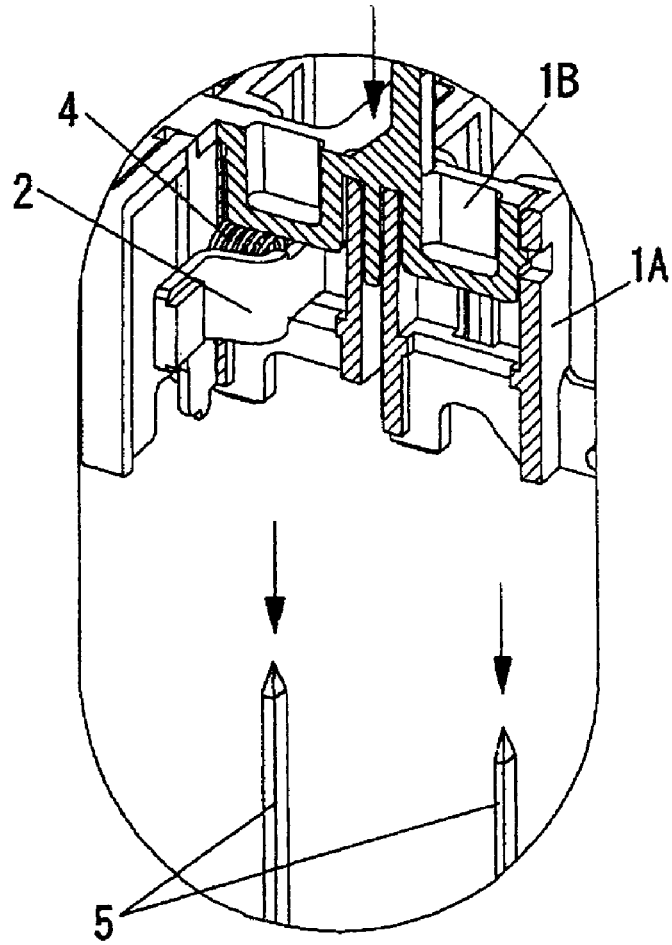
Figure 6A:
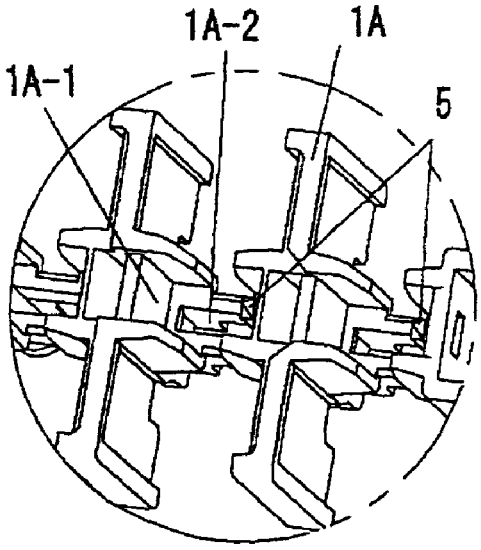
FIGS. 6A to 6E are enlarged overhead views showing the assembled states of the principal part of the movable contact holder corresponding to the assembled states shown in FIGS. 5A to 5E, respectively.
Figure 6B:
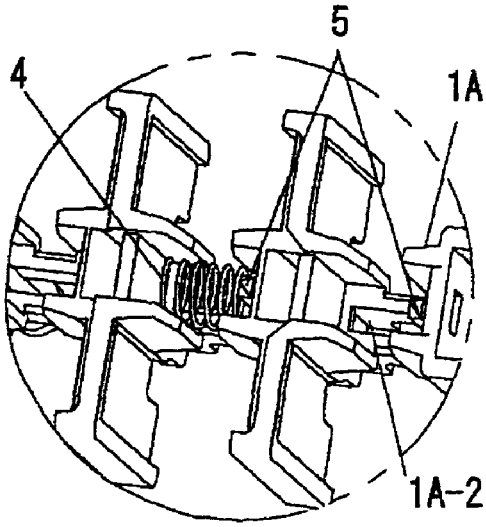
Figure 6C:
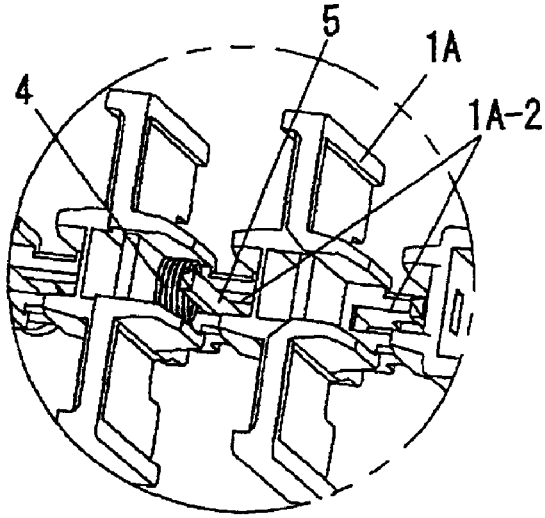
Figure 6D:
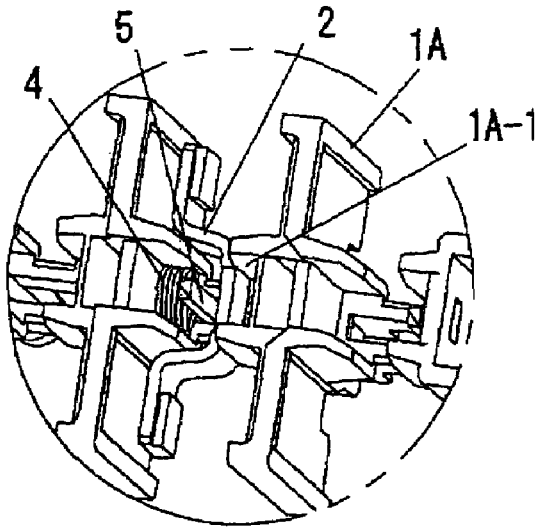
Figure 6E:
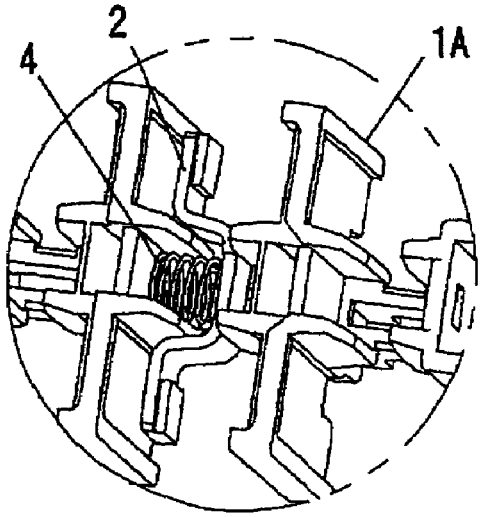
Figure 6F:
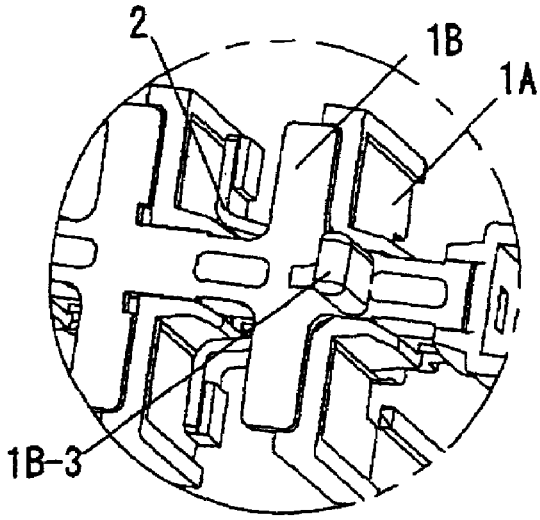
FIG. 6F is an enlarged overhead view showing the assembled state of the principal part of the movable contact holder with a movable contact holder cover being laid over the upper side of the movable contact holder base in the assembled state in FIG. 6E.

First, in a first step shown in FIG. 4A, FIG. 5A and FIG. 6A, the movable contact holder base 1A is set on an assembling system with the movable contact holder cover 1B being removed. Then, an assembling jig 5, including a plurality of pin like structures, is inserted into each of the recesses 1A-1 from the bottom side of the movable contact holder base 1A through the opening 1A-2. The inserted assembling jig 5 is thereafter brought to one end side of the opening 1A-2 in the recess 1A-1 as illustrated to be on standby. Namely, in a recess corresponding to an a-contact, the assembling jig 5 is brought to the left end side of the opening 1A-2 in the recess 1A-1. While, in a recess corresponding to a b-contact, the assembling jig 5 is brought to the right end side of the opening 1A-2 in the recess 1A-1.

In a subsequent second step (see FIG. 4B, FIG. 5B and FIG. 6B), the contact spring 4 is inserted into a space in each of the recesses 1A-1 from above the movable contact holder base 1A to be attached thereto while being kept in a free length state (in an uncompressed state), the space being between the assembling jig and a wall surface on the other end side of the opening 1A-2 inside the recess 1A-1.

Following this, in a third step (see FIG. 4C, FIG. 5C and FIG. 6C), the assembling jig 5 is shifted along each of the opening 1A-2 in the direction of compressing the contact spring 4 as indicated by arrows shown in the drawing to compress the contact spring 4 attached in each of the recesses 1A-1 in the second step from the free length state and bring the contact spring 4 to a wall surface on the other end side of the opening 1A-2 in the recess 1A-1.

In the next fourth step (see FIG. 4D, FIG. 5D and FIG. 6D), with the state in the previous step being kept as it is in which the contact spring 4 is compressed to be brought to the wall surface on the other end side of the opening 1A-2 in each of the recesses 1A-1, a bridge contact assembly 2 is inserted from above the movable contact holder base 1A into a space between a wall surface on the one end side of the opening 1A-2 and the assembling jig 5 compressing the contact spring 4. At this time, each of the bridge contact assembly 2 is inserted transversely to the direction in which the recesses 1A-1 are arranged (with two contacts being arranged on a line transverse to the direction in which the recesses 1A-1 are arranged) with the surface thereof made to stand vertically.

In the final fifth step (see FIG. 4E, FIG. 5E and FIGS. 6E and 6F), the assembling jigs 5 having been inserted into the recesses 1A-1 are drawn out downward from the movable contact holder base 1A before the movable contact holder cover 1B is laid over the upper side of the movable contact holder base 1A to be pressed downward to cover the movable contact holder 1 as shown in FIG. 6F. This allows each contact spring 4 to be released from the compressed state to press the bridge contact assembly 2 in the direction shown by white arrows in FIG. 4E. Moreover, each of the engaging pieces 1B-1 and the engaging protrusions 1B-2 of the movable contact holder cover 1B is made engaged with the movable contact holder base 1A to provide snap-fit combination of the movable contact holder base 1A and movable contact holder cover 1B. This provides the completion of the assembly of the movable contact holder 1.

As is known by the explanation of the assembling method, when attaching the components of the bridge contact assemblies 2 and the contact springs 4 to the movable contact holder 1, unlike the related assembling method explained with reference to FIGS. 11A to 11E, there are required no complex procedures such that the bridge contact assembly 2 is inserted into each of the square openings 1*a* in the movable contact holder base 1" while being made inclined and each of the contact springs 4 is pressed into a narrow space between the side wall surface inside the square openings 1*a* and the bridge contact assembly 2 while being compressed from a state in a free length. Therefore, all of the components can be attached to the movable contact holder base 1A with the opened upper side while being directly inserted into the recesses 1A-1 from the upper side. Moreover, in the assembling process, a plurality of pairs of the bridge contact assemblies and contact springs can be attached together without individually attaching a plurality of pairs of the bridge contact assemblies and the contact springs one by one like in the related method. This allows the assembling work of the movable contact holder 1 to be efficiently carried out in a short time with the use of an automatic assembling system instead of the manual work that has been carried out previously.

The whole structure of an electromagnetic contactor mounting the movable contact holder 1 according to the embodiment is shown in FIG. 7 and FIG. 8. In the drawings, reference numerals 6, 7 and 8 denote an outer case of the electromagnetic contactor, each of a plurality of stationary contact assemblies and an operating electromagnet, respectively. The outer case 6 is formed of a lower frame 6*a* and an upper frame 6*b*, a plurality of the stationary contact assemblies 7 are arranged in the upper frame 6*b* with each being made opposite to each of the bridge contact assemblies 2 held in the movable contact holder 1, and the operating electromagnet 8 is formed of a fixed core 8*a* and a movable core 8*b* and is contained in the lower frame 6*b*. The movable contact holder 1 is contained in the upper frame 6*b* to be supported therein while being guided so as to be slidable in the lateral direction.

Here, the electromagnet 8 is contained in the lower frame 6*a* with both of the surfaces of the fixed core 8*a* on the left side and the movable core 8*b* on the right side being laid horizontally so that they are made opposite to each other. Along with this, at the right end, control terminals (screw terminals) 10 are disposed to which lead wires drawn out from a coil 8*c* of the electromagnet 8 are connected. Moreover, to the movable core 8*b*, an operation lever 11 is combined for coupling the movable contact holder 1 with the movable core 8*b*. While, the upper frame 6*b* of the outer case 6 has isolation wall barriers 6*b*-1 projecting aside to the arrangement of the contact assemblies. In a region between the isolation barriers 6*b*-1 adjacent to each other, a terminal block is formed onto which a terminal section of the stationary contact assembly 7 are drawn out to be provided there as a terminal for a stationary contact with a terminal screw 9. Reference numeral 12 denotes a restoring spring (compressed coil spring) of the movable contact holder 1. The restoring spring 12 is provided between the sidewall on the left side in the upper frame 6*b* and the left end surface of the movable contact holder 1 to press the movable contact holder 4 toward the standby position on the right side.

In the electromagnetic contactor with the above structure, the movable contact holder 1 is usually on stand by at the position on the right side while being pressed by the restoring spring 12. In the standby state, as shown in FIGS. 9A and 9B, the a-contacts of the bridge contact assemblies 2 are made open and the b-contacts thereof are made closed. The excitation of the electromagnet 8 with a current made to flow in the coil 8*c* of the electromagnet 8 brings the movable core 8*b* to be attracted to the fixed core 8*a*. At the same time, the movable contact holder 1 coupled to the movable core 8*b* by means of the operation lever 11 is made to slide to be shifted leftward against the restoring force of the restoring spring 12. This makes the bridge contact assemblies 2 (with the a-contacts and the b-contacts) carry out switching operation to close and open the contacts like in a related electromagnetic contactor.

While the present invention has been particularly shown and described with reference to the preferred embodiment thereof, it will be understood by those skilled in the art that the foregoing and other changes in form and details can be made therein without departing from the spirit and scope of the present invention and still fall within the scope of the appended claims. For example, FIGS. 12A and 12B illustrate perspective views of further embodiments of the invention in which the assembly jig 5 includes pins that can be inserted from the open side of the contact holder 1A or from the side. For example, the pin 5' (which forms part of an assembly jig) can be inserted into the recesses from the open side as shown in FIG. 12A. In the illustrated embodiment, the pin 5' has a substantially flat portion 5'-1 that fits within the recess and an extended portion 5'-2 that is inserted into the opening provided in the bottom wall. While it is preferably to have the extended portion 5'-2 extend into the opening, it is also possible for the extended portion 5'-2 to be excluded such that only the flat portion 5'-1 is provided in the recess. Still further, as shown in FIG. 12B, a pin 5" can be inserted into the contact holder from the side. In such a case, the lateral walls of the recesses include jig openings 1A-6 through which a pin 5" can be inserted.

This application is based on, and claims priority to, Japanese Patent Application No: 2008-075282, filed on Mar. 24, 2008. The disclosure of the priority application, in its entirety, including the drawings, claims, and the specification thereof, is incorporated herein by reference.

What is claimed is:

1. A moveable contact holder that holds a plurality of contact pairs, each contact pair including a bridge contact assembly and a spring, the moveable contact holder comprising:

a movable contact holder base with one side thereof opened to have a plurality of recesses each for holding a contact pair isolated from other contact pairs, and a bottom wall opposite the opened side; and a movable contact holder cover that couples to the movable contact holder base, wherein the movable contact holder cover covers the opened side of the movable contact holder base, wherein the bottom wall includes a jig opening at each of the recesses, and wherein the jig openings receives an assembling jig that allows the contact pairs to be assembled.

2. The moveable contact holder as claimed in claim 1, wherein at least one sidewall of at least one recess is cut away at a central section to form a slot in the sidewall that extends downward from the opened side of the moveable contact holder base to permit the bridge contact assembly to protrude beyond the at least one sidewall.

3. An electromagnetic contactor assembly comprising:

a movable contact holder including a plurality of contact pairs, each contact pair including a bridge contact assembly and a contact spring;

a plurality of stationary contact assemblies each arranged opposite to one of the bridge contact assemblies held in the movable contact holder;

an electromagnet including a fixed core and a movable core; and a member that couples the movable contact holder to the movable core;

wherein movement of the movable core is transmitted to the movable contact holder via the member to move the bridge contact assembly of each of the contact pairs into contact with the stationary contact assemblies, wherein the movable contact holder includes a movable contact holder base with one side thereof opened to have a plurality of recesses each holding a contact pair isolated from other contact pairs, and a bottom wall opposite the opened side, wherein the bottom wall includes a jig opening at each of the recesses, and wherein the jig openings receive an assembling jig that allows the contact pairs to be assembled.

4. The electromagnetic contact assembly as claimed in claim 3, wherein:

the moveable contact holder includes a movable contact holder cover that couples to the movable contact holder base, wherein the movable contact holder cover covers the opened side of the movable contact holder base.

5. The electromagnetic contact assembly as claimed in claim 4, wherein at least one sidewall of at least one recess is cut away at a central section to form a slot in the sidewall that extends downward from the opened side of the moveable contact holder base to permit the bridge contact assembly to protrude beyond the at least one sidewall.

6. A method of assembling a moveable contact holder that holds a plurality of contact pairs, each contact pair including a bridge contact assembly and a spring, the moveable contact holder including a movable contact holder base with one side thereof opened to have a plurality of recesses each for holding a contact pair isolated from other contact pairs, and a bottom wall opposite the opened side, and a movable contact holder cover that couples to the movable contact holder base, wherein the movable contact holder cover covers the opened side of the movable contact holder base, wherein the bottom wall includes a jig opening at each of the recesses, wherein the jig openings receive an assembling jig that allows the contact pairs to be assembled, the method comprising:

a jig inserting step of inserting the assembling jig into each of the recesses via the respective jig opening and bringing the inserted assembling jig to one end side of the recess without the movable contact holder cover;

a contact spring inserting step of inserting the contact spring into a space between the assembling jig and one wall surface in each of the recesses, from the opened side of the movable contact holder base while being kept in a free length state;

a shifting step of shifting the assembling jig to compress each of the contact springs from the free length state, toward the one wall surface;

a bridge inserting step of inserting the bridge contact assembly into a space between the assembling jig and an opposite wall surface, which is opposite the one wall surface, in each of the recesses, from the opened side of the movable contact holder base to attach the bridge contact assemblies to the movable contact holder base while the contact springs are compressed a drawing step of drawing out the assembling jig from each of the recesses in the movable contact holder base after the bridge contact assemblies are attached; and a covering step of covering the opened side of the movable contact holder base with the movable contact holder cover.

7. The method of assembling the moveable contact holder as claimed in claim 6, wherein the jig insertion step, the contact spring inserting step, the shifting step, the bridge inserting step, the drawing step, and the covering step are carried out by an automatic assembling system.

8. The method of assembling the moveable contact holder as claimed in claim 6, wherein at least one sidewall of at least one recess is cut away at a central section to form a slot in the sidewall that extends downward from the opened side of the moveable contact holder base to permit the bridge contact assembly to protrude beyond the at least one sidewall.

9. The method of assembling the moveable contact holder as claimed in claim 6, wherein the assembling jig has a plurality of pins, each of which is insertable into one of the jig openings.

* * * * *